US009431727B2

(12) United States Patent
Kato et al.

(10) Patent No.: US 9,431,727 B2
(45) Date of Patent: Aug. 30, 2016

(54) TERMINAL CONNECTION STRUCTURE FOR ELECTRIC WIRE

(71) Applicant: Yazaki Corporation, Minato-ku, Tokyo (JP)

(72) Inventors: Hajime Kato, Kakegawa (JP); Kazuhiro Tomine, Kakegawa (JP); Takaaki Miyajima, Kakegawa (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days.

(21) Appl. No.: 14/816,717

(22) Filed: Aug. 3, 2015

(65) Prior Publication Data

US 2015/0340777 A1 Nov. 26, 2015

Related U.S. Application Data

(63) Continuation of application No. PCT/JP2014/052458, filed on Feb. 3, 2014.

(30) Foreign Application Priority Data

Feb. 4, 2013 (JP) ..... 2013-019917

(51) Int. Cl.
*H01R 13/60* (2006.01)
*H01R 9/05* (2006.01)
(Continued)

(52) U.S. Cl.
CPC ..... *H01R 9/05* (2013.01); *H01R 9/0524* (2013.01); *H01R 13/6592* (2013.01); *H01R 24/38* (2013.01); *H01R 2103/00* (2013.01); *H01R 2201/26* (2013.01)

(58) Field of Classification Search
CPC ..... H01R 9/0518
USPC ..... 439/585, 578, 675
See application file for complete search history.

(56) References Cited

U.S. PATENT DOCUMENTS 5,667,480 A * 9/1997 Knight ..... A61B 1/018 128/898
6,039,605 A 3/2000 Tanaka
(Continued)

FOREIGN PATENT DOCUMENTS

JP H01-124677 U 8/1989
JP H05-081971 U 11/1993
(Continued)

OTHER PUBLICATIONS

Apr. 28, 2014—International Search Report—Intl App PCT/JP2014/052458.
(Continued)

*Primary Examiner* — Phuong Dinh
(74) *Attorney, Agent, or Firm* — Banner & Witcoff, Ltd.

(57) ABSTRACT

A terminal connection structure for an electric wire, the electric wire including an internal conductor which is covered with a first insulating cover (21) and an external conductor which is provided coaxially with the internal conductor to surround an outer circumference of the first insulating cover and covered with a second insulating cover, the terminal connection structure including: a first terminal which is connected to a part where the internal conductor is exposed; a second terminal which is connected to a part where the external conductor is exposed; and an insulating portion which is interposed between the first insulating cover and the second terminal.

2 Claims, 7 Drawing Sheets

(51) Int. Cl.

| | |
|---|---|
| ***H01R 13/6592*** | (2011.01) |
| *H01R 103/00* | (2006.01) |
| *H01R 24/38* | (2011.01) |

(56) References Cited

U.S. PATENT DOCUMENTS

| | | | | |
|---|---|---|---|---|
| 6,604,961 | B2 | 8/2003 | Ichioka | |
| 7,025,598 | B2 * | 4/2006 | Ikeda | H01R 24/50 439/582 |
| 7,641,480 | B1 * | 1/2010 | Hossack | A61B 8/12 439/335 |
| 8,100,715 | B2 * | 1/2012 | Whitlock | H01R 24/38 439/580 |
| 2002/0002014 | A1 | 1/2002 | Ichioka | |
| 2003/0008555 | A1 | 1/2003 | Obata | |
| 2009/0011661 | A1 | 1/2009 | Imai | |
| 2015/0357748 | A1 * | 12/2015 | Ohmori | H01R 24/52 439/578 |

FOREIGN PATENT DOCUMENTS

| | | | |
|---|---|---|---|
| JP | H07-263082 | A | 10/1995 |
| JP | H11-040275 | A | 2/1999 |
| JP | 2000-268922 | A | 9/2000 |
| JP | 2000-286016 | A | 10/2000 |
| JP | 2003-017191 | A | 1/2003 |
| JP | 2008-159312 | A | 7/2008 |
| JP | 2009-016126 | A | 1/2009 |
| JP | 2009-159312 | A | 7/2009 |

OTHER PUBLICATIONS

Apr. 28, 2014—Written Opinion of the ISA—Intl App PCT/JP2014/052458, Eng Tran.

Jun. 14, 2016—(JP) Notification of Reasons for Refusal—App 2013-019917, Eng Tran.

* cited by examiner

TERMINAL CONNECTION STRUCTURE FOR ELECTRIC WIRE

CROSS REFERENCE TO RELATED APPLICATIONS

This application is a continuation of PCT application No. PCT/JP2014/052458, which was filed on Feb. 3, 2014 based on Japanese Patent Application (No. P2013-019917) filed on Feb. 4, 2013, the contents of which are incorporated herein by reference.

BACKGROUND OF THE INVENTION

1. Field of the Invention

The invention relates to a terminal connection structure for an electric wire.

2. Description of the Related Art

A coaxial wire has been widely used as an electric wire to be arranged in a place (for example, inside an electrical component of a car etc.) which is required to be shielded from an electromagnetic wave etc. (see JP-A-2009-16126). The coaxial wire has a configuration in which one or a plurality of internal conductors (cores) are covered with a first insulating cover (internal insulator) and an external conductor provided on an outer circumference of the internal insulator is covered with a second insulating cover (external insulator). In addition, there has been also known a configuration in which a shield conductor is provided on an outer circumference of the external insulator and the shield conductor is covered with a third insulating cover (protective sheath). Termination portions of these conductors are connected to connection terminals of the coaxial wire side respectively and connected to connection terminals, a circuit, an electric wire, etc. of a connection mating device through the connection terminals. Thus, the coaxial wire can conduct electricity to the connection mating device.

Here, assume that connection terminals of the coaxial wire side are connected to a plurality of conductors of a coaxial wire and the coaxial wire is connected to connection terminals etc. of a connection mating device through the connection terminals. In this case, the plurality of connection terminals are arranged in a terminal connection portion of the coaxial wire. For example, a connection terminal (internal conductor terminal) is connected to an internal conductor and a connection terminal (external conductor terminal) is connected to an external conductor. On this occasion, the internal conductor terminal and the external conductor terminal have to be arranged in a state in which a predetermined insulation creepage distance is secured from each other. Therefore, when an area (insulation creepage area) for securing the insulation creepage distance and a connection portion (external conductor connection area) between the external conductor and the external conductor terminal are arranged side by side in an extension direction of the coaxial wire, the size of the terminal connection portion of the coaxial wire side becomes large in a longitudinal direction (the extension direction of the coaxial wire). In addition, when a waterproof member such as a rubber stopper is arranged side by side with the insulation creepage area or the external conductor connection area in the extension direction of the coaxial wire, the size of the terminal connection portion of the coaxial wire side becomes further larger in the longitudinal direction. Accordingly, in order to achieve space saving of a connection structure between the coaxial wire and the connection mating device, it is required to reduce the size of the terminal connection portion of the coaxial wire side in the longitudinal direction.

SUMMARY OF THE INVENTION

The invention has been accomplished based on this. An object of the invention is to provide a terminal connection structure for an electric wire (coaxial wire), in which the size of a terminal connection portion of the electric wire in a longitudinal direction can be reduced.

The aforementioned object according to the invention can be achieved by the following configurations (1) to (3).

(1) A terminal connection structure for an electric wire, in which terminals are connected to an internal conductor and an external conductor respectively in the electric wire, the electric wire including the internal conductor which is covered with a first insulating cover and the external conductor which is provided coaxially with the internal conductor to surround an outer circumference of the first insulating cover and covered with a second insulating cover, the terminal connection structure including: a first terminal that is connected to a part where the first insulating cover has been peeled to expose the internal conductor; a second terminal that has a cylindrical shape surrounding an outer circumference of the first terminal and that is connected to a part where the second insulating cover has been peeled to expose the external conductor; and an insulating portion that has a cylindrical shape and that is arranged between the first insulating cover and the second terminal, wherein the insulating portion is provided in a position corresponding to a connection portion between the part where the external conductor is exposed and the second terminal.

According to the configuration (1), the insulating portion can be provided (positioned) in a position corresponding to the connection portion (external conductor terminal connection area) between the second terminal and the external conductor, and configuration can be made such that an area (conductor insulation creepage area) for securing a conductor insulation creepage distance between the internal conductor and the external conductor and the external conductor terminal connection area are overlapped with each other in a radial direction of the electric wire.

(2) The terminal connection structure for an electric wire according to the configuration (1), wherein the insulating portion is formed separately from or integrally with the second terminal.

(3) The terminal connection structure for an electric wire according to the configuration (1), further including: a housing member that includes a first terminal surrounding portion surrounding the outer circumference of the first terminal, and a second terminal surrounding portion surrounding an outer circumference of the second terminal, wherein the first terminal and the second terminal are received coaxially at an interval from each other in the housing member; and wherein the insulating portion is formed to extend from an end portion of the first terminal surrounding portion so as to cover the first insulating cover.

According to the aforementioned configurations (1) to (3), it is possible to reduce the size of the terminal connection portion of the electric wire (coaxial wire) in a longitudinal direction.

DETAILED DESCRIPTION OF THE EXEMPLARY EMBODIMENTS

Figure 1A:
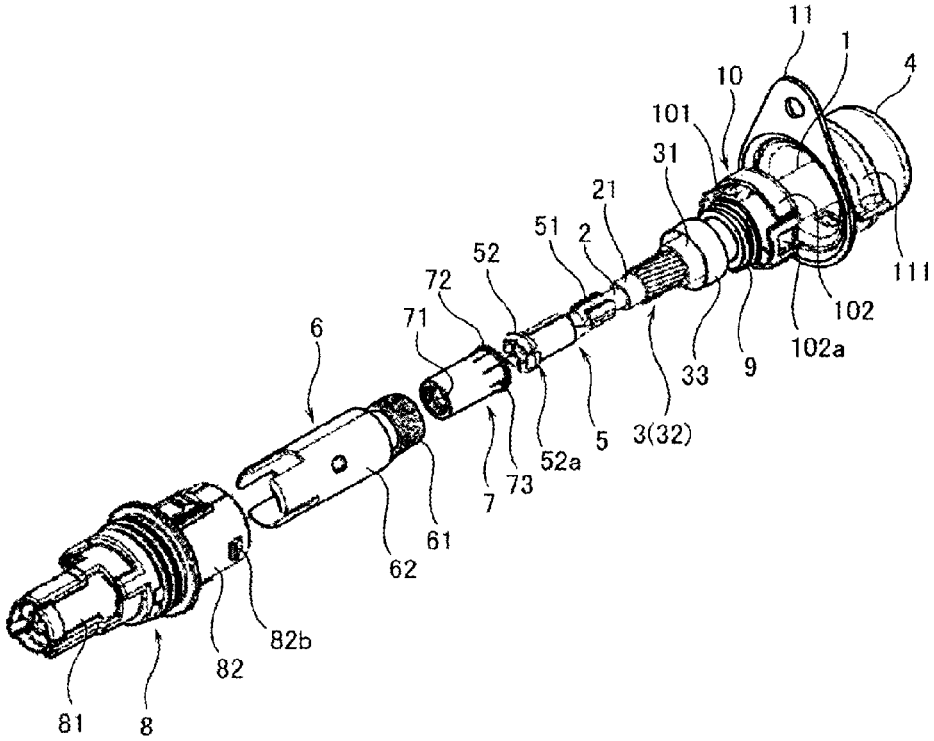
FIG. 1A is an exploded perspective view illustrating an overall terminal connection structure for an electric wire according to a first embodiment of the invention.
Figure 1B:
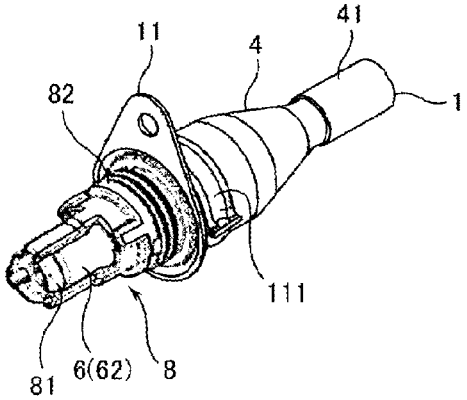
FIG. 1B is an overall perspective view illustrating a state in which constituent members illustrated in FIG. 1A are assembled.

A terminal connection structure (which will be hereinafter referred to as connection structure) for an electric wire according to the invention will be described below with reference to the accompanying drawings. The invention relates to a connection structure for an electric wire, in which terminals are connected to an internal conductor and an external conductor respectively in the electric wire. The electric wire is provided with the internal conductor which is covered with a first insulating cover, and the external conductor which is provided coaxially with the internal conductor to surround an outer circumference of the first insulating cover and covered with a second insulating cover. A coaxial wire etc. used as an electric wire to be arranged in a part (for example, inside an electrical component of a car etc.) which is required to be shielded from an electromagnetic wave etc. can be assumed as the electric wire according to the invention. However, the application of the electric wire according to invention is not limited thereto.

A connection structure according to a first embodiment of the invention is illustrated in FIG. 1A to FIG. 2B.

As illustrated in FIG. 1A to FIG. 2A, an electric wire 1 according to the first embodiment has a configuration including an internal conductor 2 which is covered with a first insulating cover (which will be hereinafter referred to as internal insulator) 21, and an external conductor 3 which is provided coaxially with the internal conductor 2 to surround an outer circumference of the internal insulator 21 and covered with a second insulating cover (which will be hereinafter referred to as external insulator) 31. In addition thereto, the electric wire 1 is provided with a shield conductor 4 which is provided coaxially with the internal conductor 2 and the external conductor 3 to surround an outer circumference of the external insulator 31 and covered with a third insulating cover (which will be hereinafter referred to as protective sheath) 41. In this case, the internal conductor 2, the external conductor 3 and the shield conductor 4 can be made into any forms. For example, the internal conductor 2 and the external conductor 3 may be assumed as stranded wires respectively and the shield conductor 4 may be assumed as a braided wire, foil, etc. In addition, each of the internal insulator 21, the external insulator 31 and the protective sheath 41 is made of an insulating material (for example, a resin such as a polyethylene resin, a vinyl chloride resin or a silicon resin). That is, the electric wire 1 is formed as a so-called coaxial wire (three-layer coaxial wire) suitable for use in a part which is required to be shielded from an electromagnetic wave etc. In the first embodiment, the following case is assumed by way of example. That is, the electric wire 1 is formed as a two-pole electric wire in which the internal conductor 2 serves as a positive potential (anode) and the external conductor 3 serves as a negative potential (cathode), or in which the internal conductor 2 serves as a negative potential and the external conductor 3 serves as a positive potential and the electric wire 1 is used in a direct current circuit. Incidentally, it may be assumed that the electric wire 1 is formed as a three-pole electric wire which has a plurality of internal conductors and which is used in a three-phase alternating current circuit or a single-phase three-wire type circuit, etc.

The connection structure according to the first embodiment has a first terminal (which will be hereinafter referred to as internal conductor terminal) 5, a second terminal (which will be hereinafter referred to as external conductor terminal) 6, and a cylindrical insulating portion (which will be hereinafter referred to as inner holder) 7. The internal conductor terminal 5 is connected to a part where the internal insulator 21 has been peeled to expose the internal conductor 2. The external conductor terminal 6 has a cylindrical shape surrounding an outer circumference of the internal conductor terminal 5. The external conductor terminal 6 is connected to a part where the external insulator 31 has been peeled to expose the external conductor 3. The inner holder 7 is interposed between the internal insulator 21 and the external conductor terminal 6. In addition thereto, the connection structure according to the first embodiment is provided with a housing member (which will be hereinafter referred to as terminal housing) 8 having a first terminal surrounding portion (which will be hereinafter referred to as internal terminal surrounding portion) 81 and a second terminal surrounding portion (which will be hereinafter referred to as external terminal surrounding portion) 82. The internal terminal surrounding portion 81 surrounds the outer circumference of the internal conductor terminal 5. The external terminal surrounding portion 82 surrounds an outer circumference of the external conductor terminal 6. The internal conductor terminal 5 and the external conductor terminal 6 are received coaxially at an interval from each other in the terminal housing 8. Incidentally, in the following description, a side (left side in FIG. 2A) where the internal conductor terminal 5 and the external conductor terminal 6 are connected in an extension direction (left/right direction in FIG. 2A) of the electric wire 1 is referred to as termination side, and an opposite side (right side in FIG. 2A) to the termination side is referred to as base side.

The internal conductor terminal 5 has a crimp portion 51 and a frontage portion 52. The internal conductor 2 is crimped to the crimp portion 51 to be connected thereto. A first terminal (terminal block internal terminal 110) of a connection mating device which will be described later is inserted into the frontage portion 52 to be connected thereto. The crimp portion 51 is crimped by caulking etc. to hold a termination portion 22 of the internal conductor 2 from which the internal insulator 21 has been peeled. Thus, the crimp portion 51 is connected to the termination portion 22. The frontage portion 52 is substantially formed into a cylindrical shape having an inner diameter set to be slightly larger than an outer diameter of the first terminal of the connection mating device. With the configuration, when the first terminal of the connection mating device inserted into the cylindrical portion of the frontage portion 52 is fitted thereto, the frontage portion 52 is connected to the first terminal of the connection mating device.

The external conductor terminal 6 is substantially formed into a cylindrical shape having an inner diameter set to be larger than a maximum diameter part (specifically, a maximum diameter part of the frontage portion 52) of the internal conductor terminal 5. With the configuration, the internal conductor terminal 5 (the crimp portion 51 and the frontage portion 52) can be received inside the cylinder of the external conductor terminal 6 (that is, the outer circumference of the internal conductor terminal 5 can be surrounded by the external conductor terminal 6). In this case, the external conductor terminal 6 has a connection portion 61 and an extension portion 62. The external conductor 3 is crimped to the connection portion 61 to be connected thereto. The extension portion 62 is received in the external terminal surrounding portion 82 of the terminal housing 8. The connection portion 61 has a configuration in which an inner diameter of the connection portion 61 is set to be slightly larger than an outer diameter of the inner holder 7 and an inner diameter of the extension portion 62 is made larger than that of the connection portion 61. That is, the external conductor terminal 6 has a two-step cylindrical structure in which the connection portion 61 and the extension portion 62 are continuous to each other concentrically. Incidentally, the external conductor terminal 6 may be formed, for example, by bending a conductor flat plate into such a cylindrical shape.

The inner holder 7 is formed by molding a non-conductive member substantially into a cylindrical shape. FIG. 3 is a perspective view illustrating the configuration of the inner holder 7. In this case, an inner diameter of the inner holder 7 is set to be slightly larger than an outer diameter of the internal insulator 21 of the electric wire 1. The inner holder 7 is put on an outer circumferential portion of the internal insulator 21 on the base side with respect to the termination portion 22 of the internal conductor 2. Incidentally, the inner holder 7 has a protruding portion 71 in which the diameter of an inner circumference on the termination side is reduced to be smaller than the outer diameter of the internal insulator 21. A collar portion 72 is provided continuously in the whole circumference of the inner holder 7 so as to protrude from a base-side terminal end edge of the inner holder 7 in a diameter expansion direction. In addition, a plurality of strip portions 73 each extending along an axial direction of the cylinder are provided circumferentially at predetermined intervals on the base side of the outer circumferential surface of the inner holder 7. The inner holder 7 is fitted into the termination side (left side in FIG. 2A by way of example) of the electric wire 1 from the collar portion 72 side. The protruding portion 71 is made to interfere with a termination-side circumferential edge of the internal insulator 21 so as to be positioned by the outer circumference of the internal insulator 21.

In the state in which the inner holder 7 is positioned thus, the external conductor terminal 6 is fitted onto an outer circumference of the inner holder 7 from the connection portion 61. A termination portion 32 of the external conductor 3 from which the external insulator 31 has been peeled is placed on an outer circumference of the connection portion 61. In this manner, the internal insulator 21, the inner holder 7, the connection portion 61 and the termination portion 32 are superimposed on one another radially from an inner side of the electric wire 1 toward an outer side thereof (see FIG. 2B). In this state, a ring member 33 (which will be hereinafter referred to as external conductor crimping ring) is put on such a superimposed portion. Incidentally, the external conductor crimping ring 33 is a member which has an inner diameter larger than the diameter of the electric wire 1 (protective sheath 41) (more specifically, the diameter of the superimposed portion (termination portion 32)) and which can be deformed easily in a diameter reduction direction when its outer circumferential portion is caulked in the whole circumference. For example, a metal ring etc. can be used as the external conductor crimping ring 33. When the external conductor crimping ring 33 put on the superimposed portion is caulked, the connection portion 61 is crimped to the termination portion 32. In this manner, the external conductor terminal 6 is connected to the external conductor 3. That is, such a superimposed portion corresponds to a connection portion (which will be hereinafter referred to as external conductor terminal connection area) A21 between the external conductor terminal 6 and the external conductor 3. The inner holder 7 is provided (positioned) in a position corresponding to the connection portion (external conductor terminal connection portion A21) between the termination portion 32 and the external conductor terminal 6. The termination portion 32 is a part where the external conductor 3 is exposed. That is, in the first embodiment, configuration is made such that an area (which will be hereinafter referred to as conductor insulation creepage area A22) for securing a conductor insulation creepage distance L22 between the internal conductor 2 and the external conductor 3 and the external conductor terminal connection area A21 are overlapped with each other in the radial direction of the electric wire 1, as illustrated in FIG. 2B. Specifically, the conductor insulation creepage area A22 is larger (longer) than the external conductor terminal connection area A21, and the external conductor terminal connection area A21 is overlapped with the conductor insulation creepage area A22 so as to be positioned more closely to the base side.

Here, the length (dimension in the axial direction of the cylinder) of the inner holder 7 may be set to be long enough to secure the conductor insulation creepage distance L22 (see FIG. 2B) between the internal conductor 2 and the external conductor 3. Although the case where the inner holder 7 is fitted and put onto the outer circumferential portion of the internal insulator 21 is assumed by way of example in the first embodiment, configuration may be made in such a manner that, for example, the inner holder 7 is joined to the internal insulator 21 by welding etc. to break a creepage path between the internal conductor 2 and the external conductor 3. When configuration is made thus to break the creepage path, the length of the inner holder 7 can be reduced. In addition, although the case where the inner holder 7 is formed separately from the external conductor terminal 6 is assumed by way of example in the first embodiment, the inner holder may be formed integrally with the external conductor terminal. For example, the inner holder may be molded integrally with the external conductor terminal, or the inner holder may be designed to be press-fitted into the external conductor terminal so that the inner holder can be handled integrally with the external conductor terminal.

In addition, the length of the inner holder 7 is set not only to be long enough to secure the conductor insulation creepage distance L22 but also to be long enough to secure a terminal insulation creepage distance L23 between the internal conductor terminal 5 and the external conductor terminal 6. In another way for understanding, configuration is made such that the inner holder 7 is protruded toward the termination side (right side in FIG. 2B) with respect to the overlapped portion between the external conductor terminal connection area A21 and the conductor insulation creepage area A22. Thus, configuration can be made such that the external conductor terminal connection area A21 and the conductor insulation creepage area A22 are overlapped with each other in the radial direction of the electric wire 1 while the terminal insulation creepage distance L23 is secured.

The terminal housing 8 has a double cylinder structure in which the internal terminal surrounding portion 81 and the external terminal surrounding portion 82 each substantially formed into a cylinder are disposed coaxially. An inner diameter of the internal terminal surrounding portion 81 is set to be slightly larger than the outer diameter of the inner holder 7. An outer diameter of the internal terminal surrounding portion 81 is set to be slightly smaller than the inner diameter of the extension portion 62 of the external conductor terminal 6. An inner diameter of the external terminal surrounding portion 82 is set to be slightly larger than a maximum outer diameter of the external conductor crimping ring 33 in the state (after caulking) in which the connection portion 61 of the external conductor external 6 and the termination portion 32 of the external conductor 3 have been crimped to each other. When the terminal housing 8 is formed to have such a double cylinder structure, the outer circumference of the internal conductor terminal 5 is surrounded by the internal terminal surrounding portion 81 and the outer circumference of the external conductor terminal 6 is surrounded by the external terminal surrounding portion 82. In this state, the internal terminal surrounding portion 81 can be interposed between the internal conductor terminal 5 and the external conductor terminal 6 (on the outer circumferential side of the internal conductor terminal 5). In addition, in this state, the internal terminal surrounding portion 81 can be positioned to make contact with the inner circumference of the external conductor terminal 6 while the external terminal surrounding portion 82 can be positioned to make contact with the outer circumference of the external conductor terminal 6. In this manner, the terminal housing 8 has a configuration in which the internal conductor terminal 5 and the external conductor terminal 6 which are disposed coaxially are separated from each other by a housing insulating portion 84, and received by the external terminal surrounding portion 82.

Incidentally, for receiving the internal conductor terminal 5 and the external conductor terminal 6 in the terminal housing 8, the terminal housing 8 is moved toward the internal conductor terminal 5 and the external conductor terminal 6 from the termination side in a state in which the internal conductor terminal 5 has been connected to the internal conductor 2 and the external conductor terminal 6 has been connected to the external conductor 3. In this manner, the internal terminal surrounding portion 81 is interposed between the internal conductor element 5 and the external conductor element 6 (on the outer circumferential side of the internal conductor terminal 5), and the external terminal surrounding portion 82 is positioned on the outer circumferential side of the external conductor terminal 6. On this occasion, the internal terminal surrounding portion 81 is brought into contact with the inner circumference of the external conductor terminal 6 while the external terminal surrounding portion 82 is brought into contact with the outer circumference of the external conductor terminal 6. That is, the external conductor terminal 6 is put between the internal terminal surrounding portion 81 and the external terminal surrounding portion 82.

In this case, the internal terminal surrounding portion 81 of the terminal housing 8 has a configuration having a lock portion (which will be hereinafter referred to as internal conductor terminal lock portion) 81*a* which is provided to protrude in an inner circumferential surface of the internal terminal surrounding portion 81 so as to be able to be engaged with a folded portion 52*a* formed in the frontage portion 52 of the internal conductor terminal 5. The inner circumferential surface of the internal terminal surrounding portion 81 is reduced in diameter gradually from the base side toward the termination side to be slanted and protruded in a taper shape to thereby form the internal conductor terminal lock portion 81*a*. On the other hand, a circumferential edge of a distal end of the frontage portion 52 is bent toward the base side and stacked on the outer circumference to thereby form the folded portion 52*a*. Accordingly, when the terminal housing 8 has been moved from the termination side toward the base side in order to receive the internal conductor terminal 5 in the terminal housing 8, the internal conductor terminal lock portion 81*a* abuts against the folded portion 52*a* to move along the folded portion 52*a* while being elastically bent and deformed to be widened outward (in the diameter expansion direction). When the internal conductor terminal lock portion 81*a* moves to reach the folded distal end of the folded portion 52*a*, the internal conductor terminal lock portion 81*a* is elastically bent and deformed to return to its original shape to be narrowed inward (in the diameter reduction direction) so as to be engaged with the folded portion 52*a*. As a result, the internal conductor terminal lock portion 81*a* is locked by the folded portion 52*a* so that the internal terminal surrounding portion 81 (generically, the terminal housing 8) is positioned relatively to the internal conductor terminal 5.

In addition, the external terminal surrounding portion 82 of the terminal housing 8 has a lock portion (which will be hereinafter referred to as inner side lock portion) 82*a* which is provided to protrude in an inner circumferential surface of the external terminal surrounding portion 82. With the configuration, the inner side lock portion 82*a* can be engaged with an opening portion (which will be hereinafter referred to as inner side opening portion) 62*a* formed in the extension portion 62 of the external conductor terminal 6. The inner circumferential surface of the external terminal surrounding portion 82 is reduced in diameter gradually from the base side toward the termination side to be slanted and protruded in a taper shape to thereby form the inner side lock portion 82*a*. On the other hand, the inner side opening portion 62*a* is formed as a hole which is made to penetrate a substantially intermediate portion of the extension portion 62 in the axial direction of the cylinder from the inner circumferential side toward the outer circumferential side. Accordingly, when the terminal housing 8 has been moved from the termination side toward the base side in order to receive the external conductor terminal 6 in the terminal housing 8, the inner side lock portion 82*a* abuts against an outer circumferential surface of the extension portion 62 to move along the outer circumferential surface to reach the inner side opening portion 62*a* while being elastically bent and deformed to be widened outward (in the diameter expansion direction). When the inner side lock portion 82*a* moves to reach the inner side opening portion 62*a*, the inner side lock portion 82*a* is elastically bent and deformed to return to its original shape so as to be narrowed inward (in the diameter reduction direction) so that the inner side lock portion 82*a* can fall into the inner side opening portion 62*a* to be engaged with the inner side opening portion 62*a*. As a result, the inner side lock portion 82*a* is locked by the inner side opening portion 62*a* so that the external terminal surrounding portion 82 (generically, the terminal housing 8) is positioned relatively to the external conductor terminal 6.

When the terminal housing 8 has moved in this manner from the termination side toward the base side in order to receive the internal conductor terminal 5 and the external conductor terminal 6 in the terminal housing 8, the internal conductor terminal lock portion 81*a* is locked by the folded portion 52*a* and the inner side lock portion 82*a* is locked by the inner side opening portion 62*a*. Consequently, the internal terminal surrounding portion 81 and the external terminal surrounding portion 82 (that is, the terminal housing 8) are positioned relatively to the internal conductor terminal 5 and the external conductor terminal 6 respectively.

In addition, in the connection structure according to the first embodiment, a waterproof member (for example, a rubber stopper) 9 is provided so as to prevent water invasion into the internal conductor terminal 5 and the external conductor terminal 6 which have been received in the terminal housing 8. The rubber stopper 9 which is made of an elastic rubber material and formed into a ring shape is press-fitted and fixed onto a portion of the external conductor 3 in front of the termination portion 32 (an outer circumferential portion of the external insulator 31 on the base side with respect to the termination portion 32). The external terminal surrounding portion 82 is fitted onto an outer circumference of the rubber stopper 9 which has been press-fitted and fixed thus onto the external insulator 31. In other words, in a state in which the external terminal surrounding portion 82 is positioned relatively to the external conductor terminal 6 (in a state in which the inner side lock portion 82*a* is locked by the inner side opening portion 62*a*), the rubber stopper 9 is fitted into a base-side end portion of the inner circumference of the external terminal surrounding portion 82. That is, the rubber stopper 9 is interposed between the external insulator 31 of the electric wire 1 and the terminal housing 8 to thereby seal the base side therebetween. In this manner, water invasion (for example, invaded water passed along the external insulator 31 of the electric wire 1) into the internal conductor terminal 5 and the external conductor terminal 6 which have been received in the terminal housing 8 can be prevented.

By use of a holder member (which will be hereinafter referred to as rear holder) 10, the internal conductor terminal 5 and the external conductor terminal 6 which have been received in the terminal housing 8 can be prevented from coming off from the terminal housing 8. The rear holder 10 is provided with a bottom portion 101 and a cylindrical wall portion 102. The bottom portion 101 has a through hole 101*a* through which the external insulator 31 of the electric wire 1 is inserted. The cylindrical wall portion 102 extends from the bottom portion 101 toward the termination side. Incidentally, the through hole 101*a* is set to have a hole diameter slightly larger than an outer diameter of the external insulator 31. An opening portion (which will be hereinafter referred to as outer side opening portion) 102*a* for locking a lock portion (which will be hereinafter referred to as outer side lock portion) 82*b* provided to protrude in an outer circumferential surface of the external terminal surrounding portion 82 of the terminal housing 8 is formed in the wall portion 102. Thus, when the outer side lock portion 82*b* is engaged with an edge portion of the outer side opening portion 102*a*, the terminal housing 8 and the rear holder 10 are positioned and fixed relatively to the electric wire 1 and the internal conductor terminal 5 and the external conductor terminal 6 can be prevented from coming off from the terminal housing 8. As a result, the internal conductor terminal 5, the external conductor terminal 6 and the terminal housing 8 can be assembled integrally with one another easily while the number of fixation points is reduced.

Incidentally, the rear holder 10 may be brought into a state in which the through hole 101*a* of the bottom portion 101 is fitted onto the external insulator 31 from the termination side before the internal conductor terminal 5 is connected to the internal conductor 2 of the electric wire 1 and before the external conductor terminal 6 is connected to the external conductor 3. During the work of connecting the internal conductor terminal 5 and the external conductor terminal 6 to the internal conductor 2 and the external conductor 3 respectively, the rear holder 10 is retracted toward the base side with respect to the termination portion 32 of the external conductor 3. After the internal conductor terminal 5 and the external conductor terminal 6 have been connected to the internal conductor 2 and the external conductor 3 respectively and received in the terminal housing 8, the rear holder 10 may be moved toward the termination side along the external insulator 31 while the through hole 101*a* of the bottom portion 101 is made to abut against the external insulator 31 so that the outer side lock portion 82*b* of the terminal housing 8 can be engaged with the outer side opening portion 102*a*. To this end, a circumferential edge of the wall portion 102 and an abutment surface of the outer side lock portion 82*b* are formed to be slanted along each other so that when the rear holder 10 is moved toward the termination side, the circumferential edge of the wall portion 102 can abut against the outer side lock portion 82*b* to run thereonto easily. Thus, the wall portion 102 which has abutted against the outer side lock portion 82*b* is elastically bent and deformed to be widened outward so as to run onto the outer side lock portion 82*b*. Then, when the outer side lock portion 82*b* falls into the outer side opening portion 102*a*, the wall portion 102 is elastically bent and deformed to return to its original shape. As a result, the outer side lock portion 82*b* is engaged with the outer side opening portion 102*a*.

In addition, in the connection structure according to the first embodiment, the protective sheath 41 has been peeled to expose the shield conductor 4, and the electric wire 1 is provided with a shield member (which will be hereinafter referred to as shield shell) 11 connected to the exposed portion (termination portion 42) of the shield conductor 4. The shield shell 11 is formed as a housing member which surrounds the outer circumference of the external terminal surrounding portion 82 of the terminal housing 8 in which the internal conductor terminal 5 and the external conductor terminal 6 have been received, to thereby shield the terminal housing 8 (that is, the terminal connection portion of the electric wire 1). The electric wire 1 is fixed to a predetermined connection mating device (for example, an electrical component etc. mounted in a car) through the shield shell 11. In this case, the exposed portion (termination portion 42) of the shield conductor 4 from which the protective sheath 41 has been peeled is arranged to be placed on an outer circumference of the shield shell 11, and crimped and connected to the outer circumferential surface of the shield shell 11 by a ring member 111 put on an outer circumference of the exposed portion (termination portion 42) of the shield conductor 4. Incidentally, the shield shell 11 is fixed to the connection mating device. For example, the shield conductor 4 is grounded through the connection mating device so that shield processing can be performed on the electric wire 1.

Figure 4:
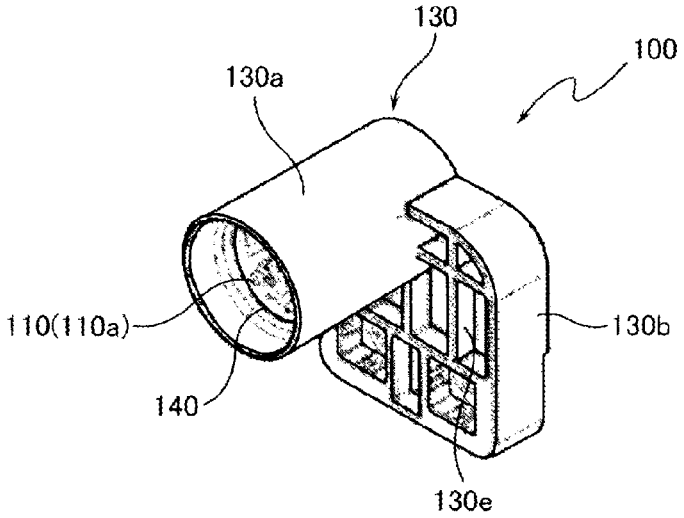
FIG. 4 is a perspective view illustrating an overall configuration of a terminal member (terminal block) in a connection mating device according to the first embodiment of the invention.
Figure 5:
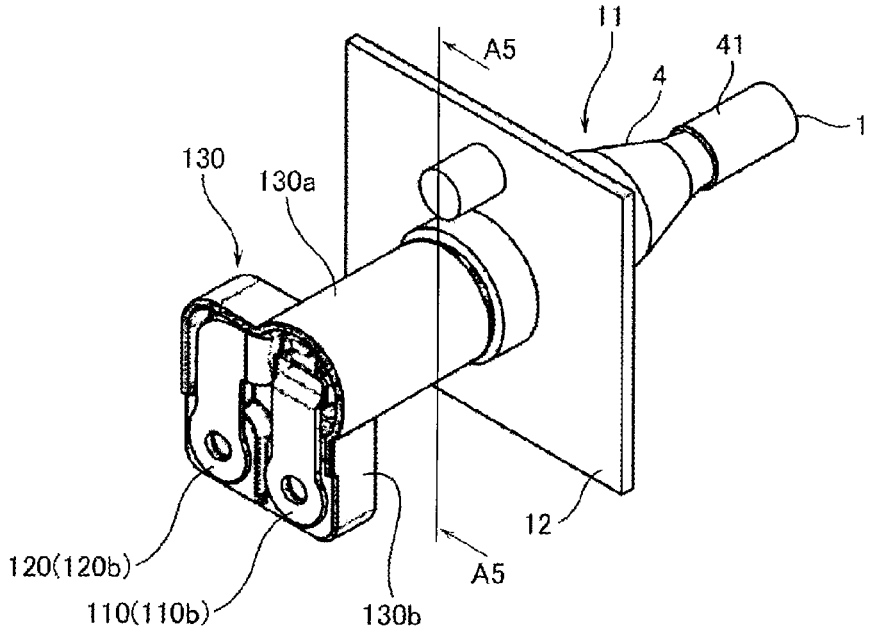
FIG. 5 is a perspective view illustrating the configuration in which the terminal block illustrated in FIG. 4 has been connected to the electric wire.
Figure 6A:
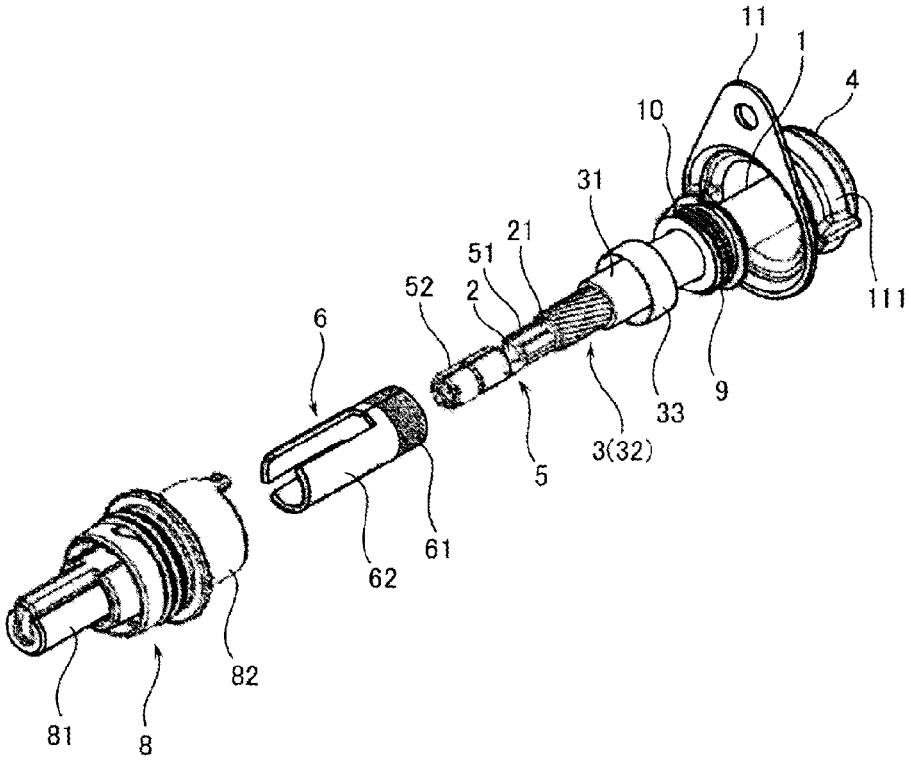
FIG. 6A is an exploded perspective view illustrating an overall terminal connection structure for an electric wire according to a second embodiment of the invention.
Figure 6B:
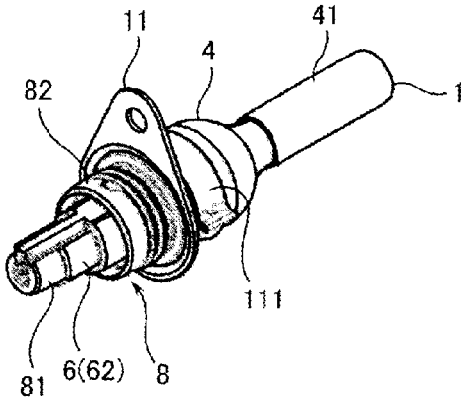
FIG. 6B is an overall perspective view illustrating a state in which constituent members illustrated in FIG. 6A have been assembled.

The internal conductor terminal 5 and the external conductor terminal 6 according to the first embodiment are connected to a terminal member (which will be hereinafter referred as terminal block) 100 in the connection mating device. The electric wire 1 can conduct electricity to the connection mating device through the terminal block 100. FIG. 4 is a perspective view illustrating an overall configuration of the terminal block 100 according to the first embodiment. FIG. 5 is a perspective view illustrating the configuration in which the terminal block 100 has been connected to the electric wire 1. Incidentally, FIG. 2A corresponds to a vertical sectional view of a portion taken along a line of arrows A5 in FIG. 5.

Figure 2A:
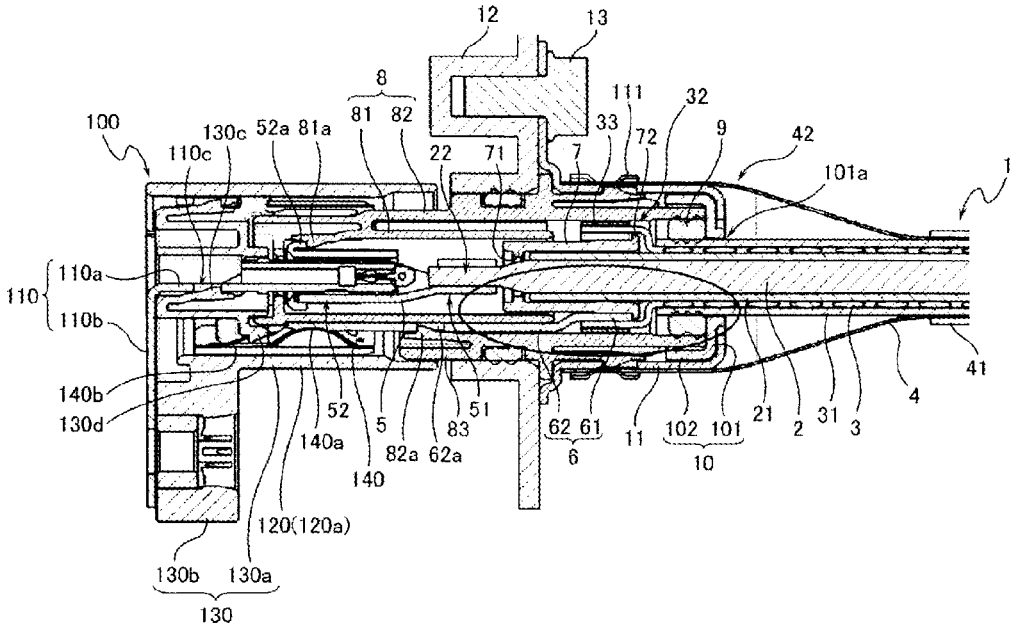
FIG. 2A is an overall sectional view illustrating the terminal connection structure for the electric wire according to the first embodiment of the invention.
Figure 2B:
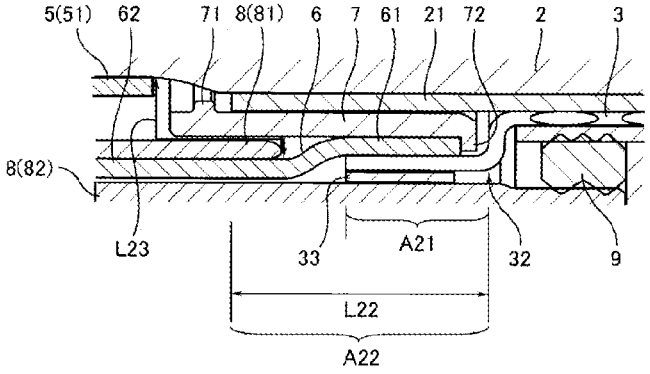
FIG. 2B is a sectional view illustrating an enlarged part inside an ellipse in FIG. 2A.
Figure 3:
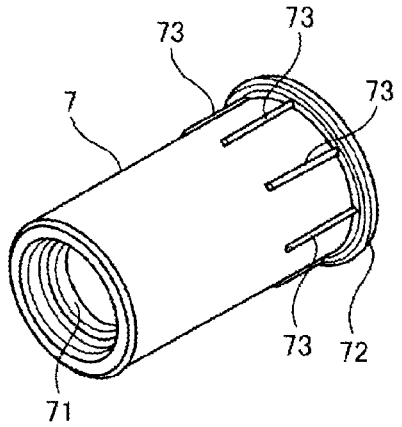
FIG. 3 is a perspective view illustrating a configuration of an insulating portion (inner holder) according to the first embodiment of the invention.

As illustrated in FIG. 2A and FIG. 4, the terminal block 100 is provided with a first terminal (which will be hereinafter referred to as terminal block internal terminal) 110, a second terminal (which will be hereinafter referred to as terminal block external terminal) 120, and a housing member (which will be hereinafter referred to as terminal block housing) 130. The terminal block internal terminal 110 is connected to the internal conductor terminal 5. The terminal block external terminal 120 is connected to the external conductor terminal 6. The terminal block housing 130 receives the terminal block internal terminal 110 and the terminal block external terminal 120.

The terminal block internal terminal 110 has an internal terminal portion 110*a* and an internal terminal contact point portion 110*b*. The internal terminal portion 110*a* is provided to extend cylindrically. The internal terminal contact point portion 110*b* is provided to protrude like a flat plate outward in the diameter expansion direction from one end of the internal terminal portion 110*a*. An outer diameter of the internal terminal portion 110*a* is set to be slightly smaller than an inner diameter of the frontage portion 52 of the internal conductor terminal 5 so that the internal terminal portion 110*a* can be inserted into the frontage portion 52 to be fitted into the cylindrical portion of the frontage portion 52 (see FIG. 2A). In addition, an opening portion (which will be hereinafter referred to as internal terminal opening portion) 110*c* for locking an internal terminal lock portion 130*c* provided in the terminal block housing 130 (specifically, a terminal block cylindrical portion 130*a*) which will be describe later is formed in the internal terminal portion 110*a*. Thus, when the internal terminal lock portion 130*c* is engaged with an edge portion of the internal terminal opening portion 110*c*, the terminal block internal terminal 110 is positioned and fixed relatively to the terminal block housing 130 and the terminal block internal terminal 110 can be prevented from being coming off from the terminal block housing 130. In this state, the internal terminal portion 110*a* is connected to the internal conductor terminal 5. The internal terminal contact point portion 110*b* is exposed outside the terminal block housing 130 in a state in which the internal terminal contact point portion 110*b* is received together with the internal terminal portion 110*a* in the terminal block housing 130. The internal terminal contact point portion 110*b* is formed as an interface when the internal terminal portion 110*a* (generically, the terminal block internal terminal 110) connected to the internal conductor terminal 5 is connected to an electric wire, a bus bar, etc. of the connection mating device.

The terminal block external terminal 120 has an external terminal portion 120*a* and an external terminal contact point portion 120*b*. The external terminal portion 120*a* is formed into a cylindrical shape which can surround an outer circumference of the internal terminal portion 110*a* in the terminal block internal terminal 110. The external terminal contact point portion 120*b* is provided to protrude like a flat plate outward in the diameter expansion direction from one end of the external terminal portion 120*a*. An inner diameter of the external terminal portion 120*a* is set to be larger than the outer diameter of the internal terminal portion 110*a*, and an outer diameter of the external terminal portion 120*a* is set to be substantially equal to an inner diameter of the terminal block cylindrical portion 130*a* of the terminal block housing 130 which will be described later. With this configuration, the external terminal portion 120*a* can be fitted into the terminal block cylindrical portion 130*a*. The external terminal contact point portion 120*b* is exposed outside the terminal block housing 130 in a state in which the external terminal contact point portion 120*b* is received together with the external terminal portion 120*a* in the terminal block housing 130. The external terminal contact point portion 120*b* is formed as an interface when the external terminal portion 120*a* (generically, the terminal block external terminal 120) connected to the external conductor terminal 6 is connected to the electric wire, the bus bar, etc. of the connection mating device.

In addition, the terminal block external terminal 120 has a spring portion (which will be hereinafter referred to as external terminal connecting spring portion) 140 for making connection with the external conductor terminal 6. Thus, the terminal block external terminal 120 can be connected to the external conductor terminal 6 through the external terminal connecting spring portion 140. The external terminal connecting spring portion 140 is formed by bending a thin plate-like conductive elastic material (for example, a metal thin plate) into a cylindrical shape having an inner diameter substantially equal to the inner diameter of the external terminal portion 120*a*. In this case, the external terminal connecting spring portion 140 may have a configuration in which a plurality of slits are formed in the external terminal connecting spring portion 140 in the axial direction of the cylinder and spring pieces 140*a* are provided between adjacent ones of the slits respectively so that the spring pieces 140*a* can be elastically bent and deformed into concave curved shapes in the diameter reduction direction. Thus, the external terminal connecting spring portion 140 can have a configuration in which the spring pieces 140*a* are elastically bent and deformed to generate predetermined elastic force (pressing force). In addition, a lock portion (which will be hereinafter referred to as spring lock portion) 140*b* protruded outward in the diameter reduction direction is provided in the external terminal connecting spring portion 140. For example, the external terminal connecting spring portion 140 may be partially notched and the notched part may be bent to be reduced in diameter gradually from the termination side toward the base side to thereby form the spring lock portion 140*b*. The spring lock portion 140*b* formed thus is engaged with an external terminal lock portion 130*d* provided in the terminal block housing 130 which will be described later, so that the external terminal connecting spring portion 140 can be locked and positioned relatively to the terminal block housing 130. In this manner, the terminal block external terminal 120 is positioned and fixed relatively to the terminal block housing 130 and the terminal block external terminal 120 can be prevented from coming off from the terminal block housing 130. In this state, the external terminal connecting spring portion 140 is positioned with the spring pieces 140*a* facing the connection portion 61. Thus, the external terminal portion 120*a* is connected to the external conductor terminal 6.

The terminal block housing 130 has a cylindrical portion (which will be hereinafter referred to as terminal block cylindrical portion) 130*a* and a retention portion 130*b*. The terminal block internal terminal 110 and the terminal block external terminal 120 are received inside the terminal block cylindrical portion 130*a*. The internal terminal contact point portion 110*b* and the external terminal contact point portion 120*b* are retained by the retention portion 130*b*. An inner diameter of the terminal block cylindrical portion 130*a* is set to be slightly larger than the outer diameter of the external terminal portion 120*a*. With this configuration, the external terminal portion 120*a* of the terminal block external terminal 120 which has been inserted from one side (corresponding to the termination side) in the axial direction of the cylinder can be fitted into the terminal block cylindrical portion 130*a*. In addition, the inner diameter of the terminal block cylindrical portion 130*a* is set to be larger than an outer diameter of the external terminal surrounding portion 82. With this configuration, the terminal block cylindrical portion 130*a* can be fitted onto a fitting portion 83 formed in the terminal housing 8, when the terminal block 100 is connected to the electric wire 1 as will be described later.

A lock portion (which will be hereinafter referred to as internal terminal lock portion) 130*c* for locking the internal terminal portion 110*a* of the terminal block internal terminal 110 inserted from one side (corresponding to the termination side) in the axial direction of the cylinder in the same manner as that for locking the external terminal portion 120*a* is provided in the terminal block cylindrical portion 130*a*. In this case, the internal terminal lock portion 130*c* is formed integrally with the terminal block cylindrical portion 130*a* so as to be extended like a cantilever toward the inside of the cylinder of the terminal block cylindrical portion 130*a*. In this manner, the internal terminal lock portion 130*c* has a so-called spring structure. When the internal terminal lock portion 130*c* is engaged with an edge portion of the internal terminal opening portion 110*c*, the terminal block internal terminal 110 is positioned and fixed relatively to the terminal block housing 130 and the terminal block internal terminal 110 can be prevented from coming off from the terminal block housing 130.

In addition, a lock portion (which will be hereinafter referred to as external terminal lock portion) 130*d* for locking the external terminal portion 120*a* of the terminal block external terminal 120 (specifically, the spring lock portion 140*b*) inserted from the one side (corresponding to the termination side) in the axial direction of the cylinder is provided in the terminal block cylindrical portion 130*a*. In this case, the external terminal lock portion 130*d* is molded integrally with the terminal block cylindrical portion 130*a* so as to be extended like a cantilever toward the inside of the cylinder of the terminal block cylindrical portion 130*a*. In this manner, the external terminal lock portion 130*d* has a so-called spring structure. When the external terminal lock portion 130*d* is engaged with the spring lock portion 140*b*, the terminal block external terminal 120 is positioned and fixed relatively to the terminal block housing 130 and the terminal block external terminal 120 can be prevented from coming off from the terminal block housing 130.

In this manner, the terminal block internal terminal 110 and the terminal block external terminal 120 are assembled integrally with the terminal block cylindrical portion 130*a*. In this state, the terminal block internal terminal 110 and the terminal block external terminal 120 are disposed coaxially at an interval from each other in the terminal block housing 130, and received by the terminal block cylindrical portion 130*a*. That is, the terminal block internal terminal 110 and the terminal block external terminal 120 which have been received in the terminal block housing 130 are disposed at a fixed interval from each other. Incidentally, the retention portion 130*b* is a frame which protrudes outward from an outer circumferential surface of the terminal block cylindrical portion 130*a*. The retention portion 130*b* is reinforced by ribs 130*e* which are arranged in a grid pattern. In the state in which the terminal block internal terminal 110 and the terminal block external terminal 120 have been assembled integrally with the terminal block cylindrical portion 130*a*, the internal terminal contact point portion 110*b* and the external terminal contact point portion 120*b* are made to abut against the ribs 130*e* and retained by the retention portion 130*b*.

The terminal block 100 in which the terminal block internal terminal 110 and the terminal block external terminal 120 have been assembled thus integrally with the terminal block housing 130 is connected to the electric wire 1. Specifically, the internal terminal portion 110*a* of the terminal block internal terminal 110 is connected to the internal conductor terminal 5 while the external terminal portion 120*a* of the terminal block external terminal 120 is connected to the external conductor terminal 6. On this occasion, the electric wire 1 and the terminal block 100 are fitted to each other so that a distal end portion (termination-side end portion (left end portion in FIG. 2A) of the internal terminal surrounding portion 81 of the terminal housing 8 can be brought into abutment against the external terminal lock portion 130*d* of the terminal block housing 130. Thus, the internal conductor terminal 5 and the internal terminal portion 110*a* are positioned in a connection state, and the external conductor terminal 6 and the external terminal portion 120*a* are positioned in a connection state. The internal terminal contact point portion 110*b* of the terminal block internal terminal 110 which has been connected to the internal conductor terminal 5 is connected to an electric wire, a bus bar, etc. of the connection mating device, while the external terminal contact point portion 120*b* of the terminal block external terminal 120 which has been connected to the external conductor terminal 6 is connected to the electric wire, the bus bar, etc. of the connection mating device. In this manner, the electric wire 1 can conduct electricity to the connection mating device through the terminal block 100. Incidentally, the electric wire 1 which has been connected to the terminal block 100 is fixed to a fixation member 12 of the connection mating device through the shield shell 11 by a fixation member 13 such as a screw (see FIG. 5).

The aforementioned connection structure according to the first embodiment has a configuration in which the inner holder 7 is interposed between the internal insulator 21 and the external conductor terminal 6 so that the external conductor terminal connection area A21 and the conductor insulation creepage area A22 are overlapped with each other in the radial direction of the electric wire 1. In addition, configuration is made such that the inner holder 7 protrudes toward the termination side with respect to the overlapped portion between the external conductor terminal connection area A21 and the conductor insulation creepage area A22 on this occasion. Thus, configuration can be made such that the external conductor terminal connection area A21 and the conductor insulation creepage area A22 are overlapped with each other while the terminal insulation creepage distance L23 is secured. Consequently, it is possible to reduce the longitudinal size of the terminal connection portion of the electric wire 1 including the internal conductor terminal 5, the external conductor terminal 6, the terminal housing 8, etc. while securing both the conductor insulation creepage distance L22 and the terminal insulation creepage distance L23. Accordingly, for example, even in the case where a water invasion prevention area (fixation part of the rubber stopper 9) of the electric wire 1 is arranged side by side with the external conductor terminal connection area A21 and the conductor insulation creepage area A22 in the extension direction of the electric wire 1, the longitudinal size of the terminal connection portion of the electric wire 1 can be suppressed from increasing.

Here, in the aforementioned connection structure (see FIG. 1A to FIG. 2B) according to the first embodiment, configuration can be made such that the inner holder 7 serving as an insulating portion is interposed between the internal insulator 21 and the external conductor terminal 6 so that the external conductor terminal connection area A21 and the conductor insulation creepage area A22 are overlapped with each other in the radial direction of the electric wire 1. However, the terminal connection structure according to the invention is not limited to such a configuration. For example, also when a connection structure according to a second embodiment of the invention illustrated in FIG. 6A to FIG. 7B is used, a similar function or effect can be obtained. The second embodiment (see FIG. 6A to FIG. 7B) will be described below. Incidentally, the basic configuration other than an insulating portion in the second embodiment is made the same as that in the aforementioned first embodiment (see FIG. 1A to FIG. 2B). Therefore, constituents the same as or similar to those in the first embodiment will be referred to by the same symbols respectively on the drawings and description thereof will be omitted. Thus, a configuration unique to the second embodiment (see FIG. 6A to FIG. 7B) will be described below in detail.

The connection structure according to the second embodiment of the invention is illustrated in FIG. 6A to FIG. 7B.

In the second embodiment, as illustrated in FIG. 6A to FIG. 7B, an insulating portion (which will be hereinafter referred to as housing insulating portion) 84 is provided (positioned) in a position corresponding to a connection portion (external conductor terminal connection portion A71) between a termination portion 32 and an external conductor terminal 6. The termination portion 32 is a part where an external conductor 3 is exposed. In this case, the housing insulating portion 84 is formed to extend from an end portion (base-side end portion) of an internal terminal surrounding portion 81 to cover an internal insulator (first insulating cover) 21. The internal terminal surrounding portion 81 serves as a first terminal surrounding portion of a terminal housing 8. That is, in the second embodiment, the housing insulating portion 84 is formed integrally with the internal terminal surrounding portion 81. In this case, the housing insulating portion 84 may be molded integrally with the terminal housing 8 together with the internal terminal surrounding portion 81. Incidentally, the terminal housing 8 may have a configuration in which at least a portion forming the housing insulating portion 84 is made of a non-conductive member.

An inner diameter of the housing insulating portion 84 is set to be larger than an outer diameter of the internal insulator 21 of the electric wire 1. An outer diameter of the housing insulating portion 84 is set to be slightly smaller than an inner diameter of a connection portion 61 of the external conductor terminal 6. In a state in which an internal conductor terminal 5 and the external conductor terminal 6 have been received in the terminal housing 8, the housing insulating portion 84 is positioned to entirely cover an outer circumference of the internal insulator 21 (specifically, an outer circumferential portion of an internal conductor 2 on a base side with respect to a termination portion 22) with a predetermined gap therebetween. In addition, in such a state, the housing insulating portion 84 is brought into close contact with the connection portion 61 of the external conductor terminal 6.

In addition, the termination portion 32 of the external conductor 3 from which an external insulator 31 has been peeled is placed on an outer circumference of the connection portion 61 of the external conductor terminal 6. When an external conductor crimping ring 33 placed on the termination portion 32 is caulked, the connection portion 61 is crimped to the termination portion 32. In this manner, the external conductor terminal 6 and the external conductor 3 are connected to each other.

Figure 7A:
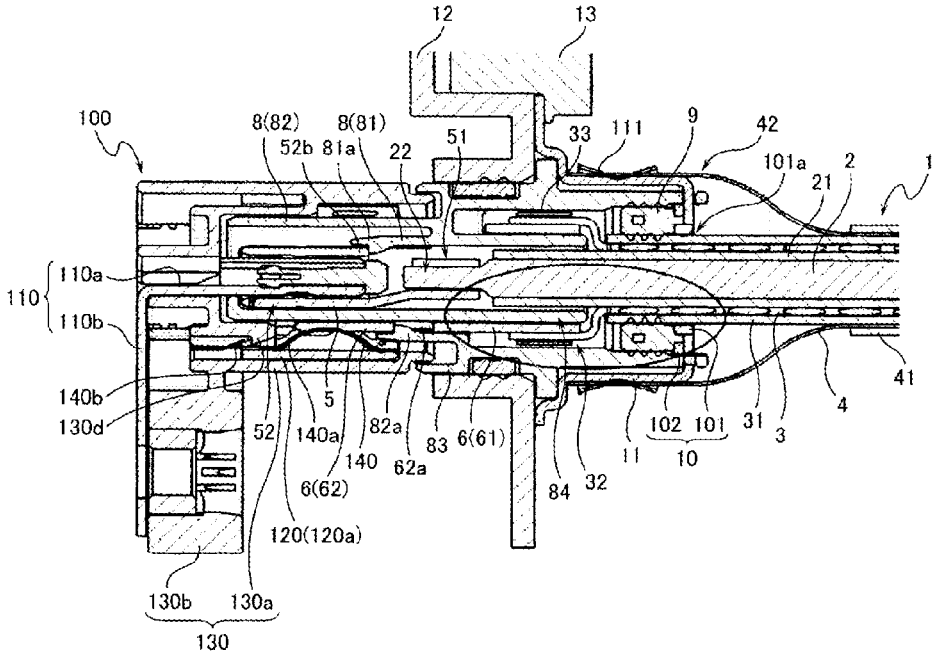
FIG. 7A is an overall sectional view illustrating the terminal connection structure for the electric wire according to the second embodiment of the invention.
Figure 7B:
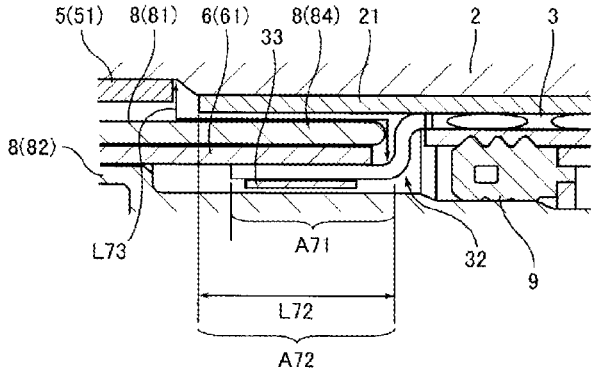
FIG. 7B is a sectional view illustrating an enlarged part inside an ellipse in FIG. 7A.

In this state, the internal insulator 21, the housing insulating portion 84, the connection portion 61, the termination portion 32, and the external conductor crimping ring 33 are superimposed on one another radially from an inner side of the electric wire 1 toward an outer side thereof (see FIG. 7B). That is, the superimposed portion corresponds to the connection portion (the external conductor terminal connection area) A71 between the external conductor terminal 6 and the external conductor 3. The housing insulating portion 84 is provided in a position corresponding to the external conductor terminal connection portion A71. That is, in the second embodiment, configuration is made such that an area (which will be hereinafter referred to as conductor insulation creepage area A72) for securing a conductor insulation creepage distance L72 between the internal conductor 2 and the external conductor 3 and the external conductor terminal connection area A71 are overlapped with each other in the radial direction of the electric wire 1, as illustrated in FIG. 7B. Specifically, the conductor insulation creepage area A72 is larger (longer) than the external conductor terminal connection area A71 and the external conductor terminal connection area A71 is overlapped with the conductor insulation creepage area A72 so as to be positioned more closely to the base side.

Incidentally, the length (dimension in an axial direction of a cylinder) of the housing insulating portion 84 may be set to be long enough to secure the conductor insulation creepage distance L72 (see FIG. 7B) between the internal conductor 2 and the external conductor 3. In addition, the length of the housing insulating portion 84 is set not only to be long enough to secure the conductor insulation creepage distance L72 but also to be long enough to secure a terminal insulation creepage distance L73 between the internal conductor terminal 5 and the external conductor terminal 6. In another way for understanding, configuration is made such that the housing insulating portion 84 protrudes toward the termination side (right side in FIG. 7B) with respect to the overlapped portion between the external conductor terminal connection area A71 and the conductor insulation creepage area A72. Thus, configuration is made such that the external conductor terminal connection area A71 and the conductor insulation creepage area A72 are overlapped with each other while the terminal insulation creepage distance L73 is secured.

Here, for receiving the internal conductor terminal 5 and the external conductor terminal 6 in the terminal housing 8, the terminal housing 8 is moved toward the internal conductor terminal 5 and the external conductor terminal 6 from the termination side in a state in which the internal conductor terminal 5 has been connected to the internal conductor 2 and the external conductor terminal 6 has been connected to the external conductor 3. Thus, the internal terminal surrounding portion 81 including the housing insulating portion 84 is interposed between the internal conductor terminal 5 and the external conductor terminal 6 (on an outer circumferential side of the internal conductor terminal 5), while an external terminal surrounding portion 82 is positioned on the outer circumferential side of the external conductor terminal 6. On this occasion, the internal terminal surrounding portion 81 (including the housing insulating portion 84) makes contact with an inner circumference of the external conductor terminal 6 while the external terminal surrounding portion 82 makes contact with the outer circumference of the external conductor terminal 6. That is, the external conductor terminal 6 is put between the internal terminal surrounding portion 81 (including the housing insulating portion 84) and the external terminal surrounding portion 82.

In this case, when the terminal housing 8 has been moved toward the base side from the termination side in order to receive the internal conductor terminal 5 in the terminal housing 8, an internal conductor terminal lock portion 81*a* abuts against a frontage portion 52 of the internal conductor terminal 5 to move along the frontage portion 52 while being elastically bent and deformed to be widened outward (in a diameter expansion direction). When the internal conductor terminal lock portion 81*a* moves to reach a distal end of the frontage portion 52, the internal conductor terminal lock portion 81*a* is elastically bent and deformed to return to its original shape to be narrowed inward (in a diameter reduction direction) so as to be engaged with the distal end portion 52*b* of the frontage portion 52. As a result, the internal conductor terminal lock portion 81*a* is locked by the distal end portion 52*b* and the internal terminal surrounding portion 81 (generically, the terminal housing 8) is positioned relatively to the internal conductor terminal 5. In addition, when the terminal housing 8 is moved from the termination side toward the base side in order to receive the external conductor terminal 6 in the terminal housing 8, an inner side lock portion 82*a* is locked by an inner side opening portion 62*a* so that the external terminal surrounding portion 82 (generically, the terminal housing 8) is positioned relatively to the external conductor terminal 6.

Incidentally, in the same manner as in the aforementioned first embodiment, a waterproof member (rubber stopper) 9 is provided to prevent water invasion into the internal conductor terminal 5 and the external conductor terminal 6 which have been received in the terminal housing 8, a holder member (rear holder) 10 is provided to prevent the internal conductor terminal 5 and the external conductor terminal 6 from coming off from the terminal housing 8, and a shield member (shield shell) 11 is provided to shield the terminal connection portion of the electric wire 1.

Figure 8:
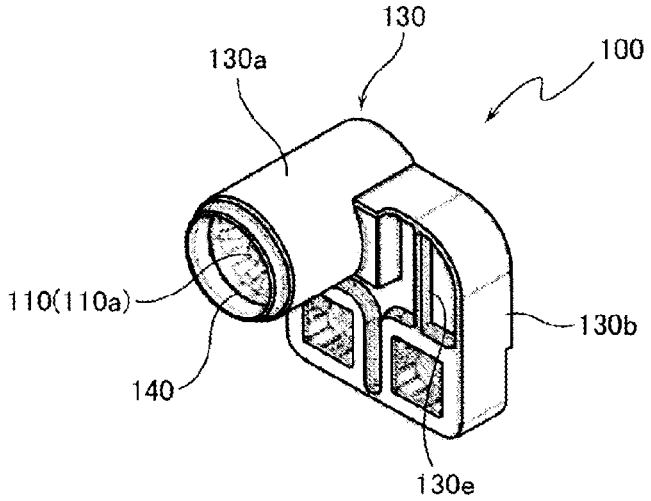
FIG. 8 is a perspective view illustrating an overall configuration of a terminal member (terminal block) in a connection mating device according to the second embodiment of the invention.
Figure 9:
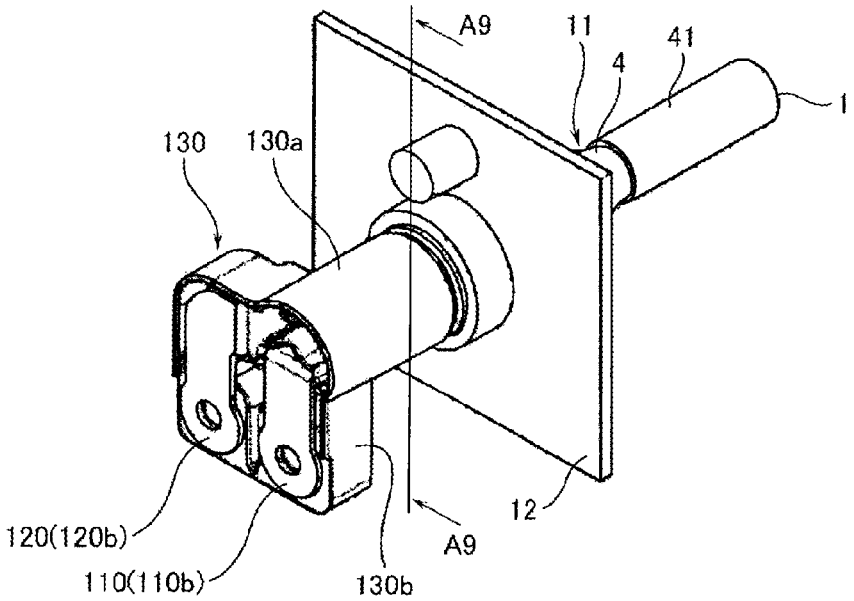
FIG. 9 is a perspective view illustrating the configuration in which the terminal block illustrated in FIG. 8 has been connected to the electric wire.

In addition, in the same manner as in the aforementioned first embodiment, the internal conductor terminal 5 and the external conductor terminal 6 are connected to a terminal member (terminal block) 100 in a connection mating device according to the second embodiment so that the electric wire 1 can conduct electricity to the connection mating device through the terminal block 100. FIG. 8 is a perspective view illustrating an overall configuration of the terminal block 100. FIG. 9 is a perspective view illustrating the configuration in which the terminal block 100 has been connected to the electric wire 1. Incidentally, FIG. 7A corresponds to a vertical sectional view of a portion taken along a line of arrows A9 in FIG. 9.

As illustrated in FIG. 7A and FIG. 8, the terminal block 100 is provided with a first terminal (which will be hereinafter referred to as terminal block internal terminal) 110, a second terminal (which will be hereinafter referred to as terminal block external terminal) 120, and a housing member (which will be hereinafter referred to as terminal block housing) 130. The terminal block internal terminal 110 is connected to the internal conductor terminal 5. The terminal block external terminal 120 is connected to the external conductor terminal 6. The terminal block housing 130 receives the terminal block internal terminal 11 and the terminal block external terminal 12. The terminal block 100 in which the terminal block internal terminal 110 and the terminal block external terminal 120 are assembled integrally with the terminal block housing 130 is connected to the electric wire 1. Specifically, an internal terminal portion 110*a* of the terminal block internal terminal 110 is connected to the internal conductor terminal 5, while an external terminal portion 120*a* of the terminal block external terminal 120 is connected to the external conductor terminal 6. An internal terminal contact point portion 110*b* of the terminal block internal terminal 110 which has been connected to the internal conductor terminal 5 is connected to an electric wire, a bus bar, etc. of the connection mating device, while an external terminal contact point portion 120*b* of the terminal block external terminal 120 which has been connected to the external conductor terminal 6 is connected to the electric wire, the bus bar, etc. of the connection mating device. Thus, the electric wire 1 can conduct electricity to the connection mating device through the terminal block 100. Incidentally, the electric wire 1 which has been connected to the terminal block 100 is fixed to a fixation member 12 of the connection mating device by a fixation member 13 such as a screw through a shield shell 11.

In this manner, according to the connection structure according to the first embodiment (see FIG. 1A to FIG. 2B) or the second embodiment (see FIG. 6A to FIG. 7B), it is possible to reduce the size of the terminal connection portion of the electric wire 1 in the longitudinal direction.

Here, the aforementioned characteristics of the embodiments of the terminal connection structure for the electric wire according to the invention will be summarized briefly into the following configurations [1] to [3].

[1] A terminal connection structure for an electric wire 1, in which terminals are connected to an internal conductor 2 and an external conductor 3 respectively in the electric wire 1, the electric wire 1 including the internal conductor 2 which is covered with a first insulating cover (internal insulator) 21 and the external conductor 3 which is provided coaxially with the internal conductor 2 to surround an outer circumference of the first insulating cover (internal insulator) 21 and covered with a second insulating cover (external insulator) 31, the terminal connection structure including:

a first terminal (internal conductor terminal) 5 which is connected to a part where the first insulating cover (internal insulator) 21 has been peeled to expose the internal conductor 2;

a second terminal (external conductor terminal) 6 which has a cylindrical shape surrounding an outer circumference of the first terminal (internal conductor terminal) 5 and which is connected to a part where the second insulating cover (external insulator) 31 has been peeled to expose the external conductor 3; and an insulating portion (an inner holder or a housing insulating portion) 7, 84 which has a cylindrical shape and which is arranged between the first insulating cover (internal insulator) 21 and the second terminal (external conductor terminal) 6, wherein the insulating portion (the inner holder or the housing insulating portion) 7,84 is provided in a position corresponding to a connection portion between the part where the external conductor 3 is exposed and the second terminal (external conductor terminal) 6.

[2] The terminal connection structure for an electric wire 1 according to the configuration [1], wherein the insulating portion (the inner holder or the housing insulating portion) 7,84 is formed separately from or integrally with the second terminal (external conductor terminal) 6.

[3] The terminal connection structure for an electric wire 1 according to the configuration [1], further including: a housing member (terminal housing) 8 which has a first terminal surrounding portion (internal terminal surrounding portion) 81 surrounding the outer circumference of the first terminal (internal conductor terminal) 5, and a second terminal surrounding portion (external terminal surrounding portion) 82 surrounding an outer circumference of the second terminal (external conductor terminal) 6, wherein the first terminal (internal conductor terminal) 5 and the second terminal (external conductor terminal) 6 are received coaxially at an interval from each other in the housing member (terminal housing) 8; and wherein the insulating portion (housing insulating portion) 84 is formed to extend from an end portion of the first terminal surrounding portion (internal terminal surrounding portion) 81 so as to cover the first insulating cover (internal insulator) 21.

According to the terminal connection structure for the electric wire according to the invention, it is possible to reduce the size of the terminal connection portion of the electric wire (coaxial wire) in the longitudinal direction.

What is claimed is:

1. A terminal connection structure for an electric wire, in which terminals are connected to an internal conductor and an external conductor respectively in the electric wire, the electric wire comprising the internal conductor which is covered with a first insulating cover and the external conductor which is provided coaxially with the internal conductor to surround an outer circumference of the first insulating cover and covered with a second insulating cover, the terminal connection structure comprising:

a first terminal that is connected to a part where the first insulating cover has been peeled to expose the internal conductor;

a second terminal that has a cylindrical shape surrounding an outer circumference of the first terminal and that is connected to a part where the second insulating cover has been peeled to expose the external conductor; and an insulating portion that has a cylindrical shape and that is arranged between the first insulating cover and the second terminal;

wherein the insulating portion is formed integrally with the second terminal, and is provided in a position corresponding to a connection portion between the part where the external conductor is exposed and the second terminal.

2. The terminal connection structure for an electric wire according to claim 1, further comprising:

a housing member that comprises a first terminal surrounding portion surrounding the outer circumference of the first terminal, and a second terminal surrounding portion surrounding an outer circumference of the second terminal, wherein the first terminal and the second terminal are received coaxially at an interval from each other in the housing member; and wherein the insulating portion is formed to extend from an end portion of the first terminal surrounding portion so as to cover the first insulating cover.

* * * * *